US006971420B2

(12) United States Patent
Demitry

(10) Patent No.: US 6,971,420 B2
(45) Date of Patent: Dec. 6, 2005

(54) PAINT MAT

(76) Inventor: Thomas Christopher Demitry, 41 Silent Meadow La., Orchard Park, NY (US) 14127

( * ) Notice: Subject to any disclaimer, the term of this patent is extended or adjusted under 35 U.S.C. 154(b) by 162 days.

(21) Appl. No.: 10/287,729

(22) Filed: Nov. 4, 2002

(65) Prior Publication Data

US 2004/0083956 A1 May 6, 2004

(51) Int. Cl.[7] ..... B65B 1/04
(52) U.S. Cl. ..... 141/88; 141/87; 220/571.1
(58) Field of Search ..... 141/86–88; 222/108, 222/566; 220/571, 571.1

(56) References Cited

U.S. PATENT DOCUMENTS 2,131,878 A * 10/1938 Lawrence ..... 215/394
3,013,688 A * 12/1961 Luning ..... 215/376
3,352,450 A * 11/1967 Rawlins ..... 220/571.1
3,606,074 A * 9/1971 Hayes ..... 220/212
4,325,323 A * 4/1982 Rioux ..... 118/504
4,722,442 A * 2/1988 Smith ..... 206/515
5,759,275 A * 6/1998 Shostak ..... 118/504
5,983,960 A * 11/1999 Haugh ..... 141/106

* cited by examiner

*Primary Examiner*—Timothy L. Maust
(74) *Attorney, Agent, or Firm*—Vincent G. LoTempio

(57) ABSTRACT

A paint mat, removably attachable to the base of a paint can, for collecting spills and drips from the paint can during use. The paint mat includes an attachment means, such as a magnet, in the central portion thereof, for attachment to the base of the paint can. When attached, the paint mat extends beyond the perimeter of the paint can. The paint mat may include an aperture distal to the central portion but not extending past the perimeter of the base. The semi-rigid board also includes an advertisement on at least one side thereof and an extension therefrom so as to allow a brush to rest.

10 Claims, 3 Drawing Sheets

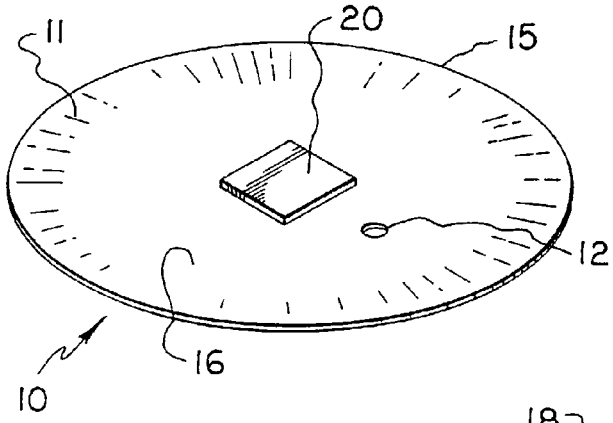
FIG. 1
FIG. 2
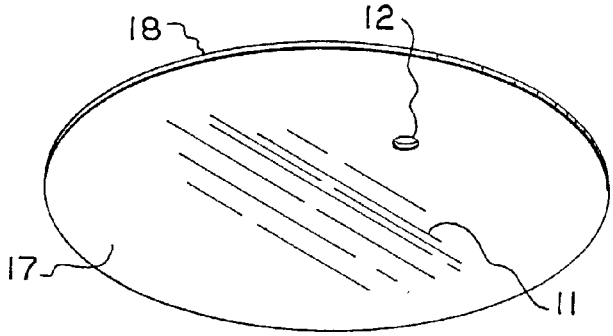
FIG. 3
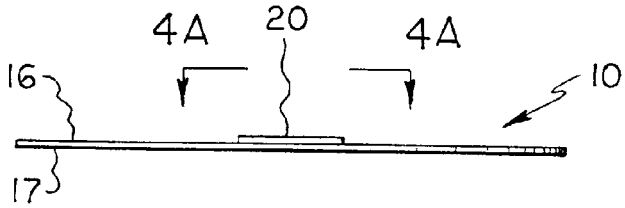
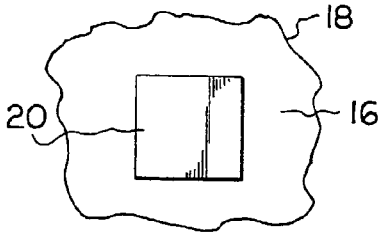
FIG. 4A
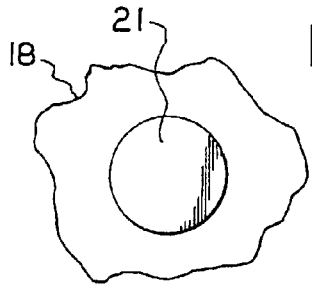
FIG. 4B
FIG. 4D
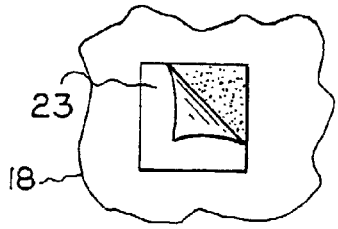
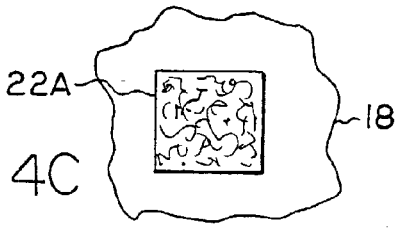
FIG. 4C

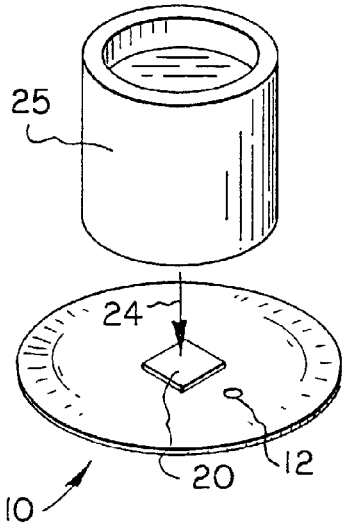
FIG. 5
FIG. 6
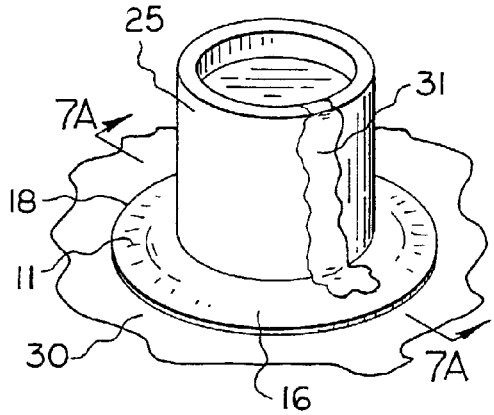
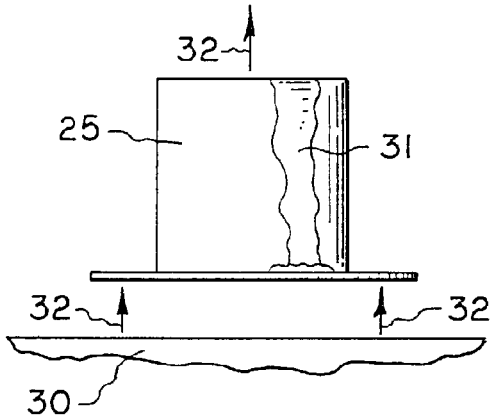
FIG. 8
FIG. 7A
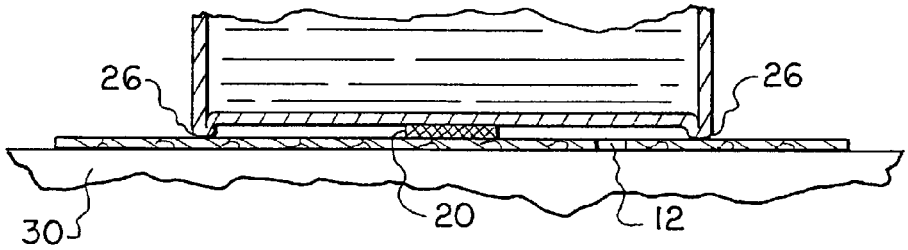
FIG. 7B
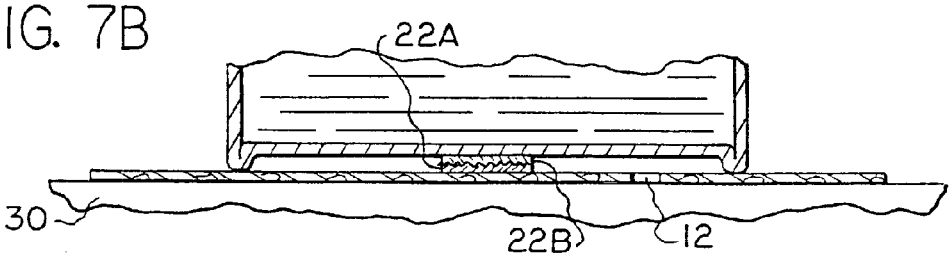

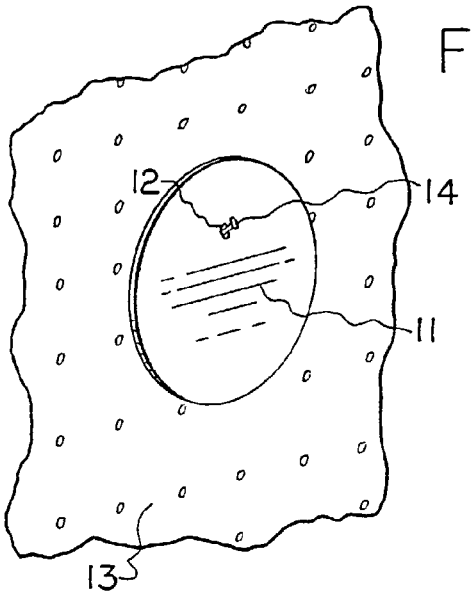
FIG. 9
FIG. 10
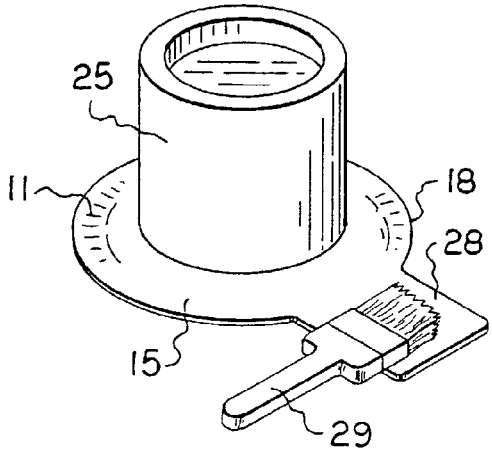
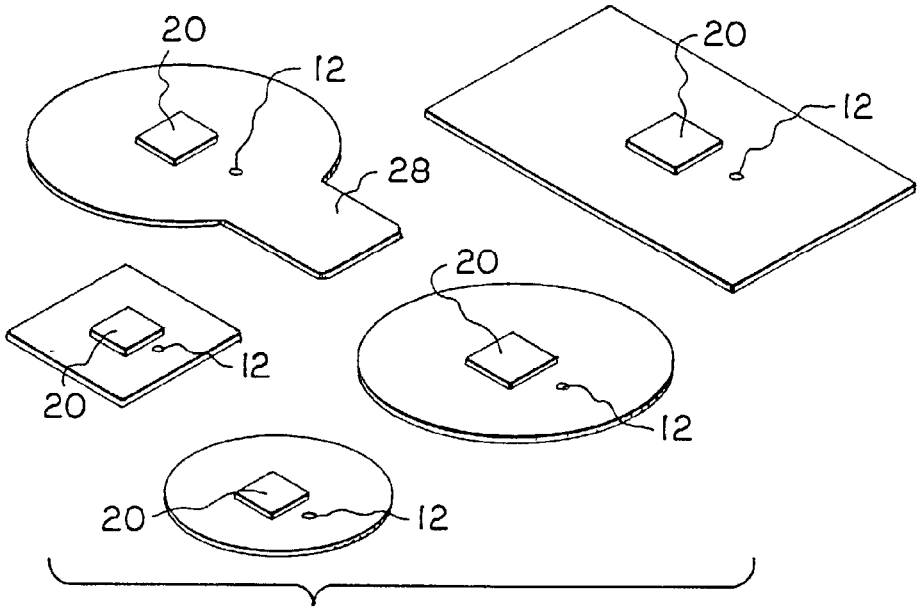
FIG. 11
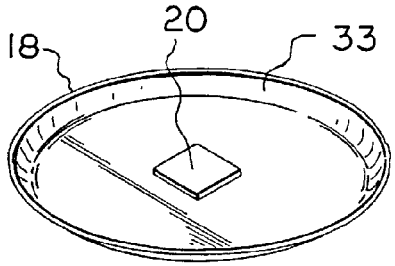
FIG. 12

PAINT MAT

BACKGROUND OF THE INVENTION

1. Field of the Invention

The present invention relates to a device for catching drips from an open liquid container such as a paint can.

2. Brief Description of the Prior Art

Liquids, such as paint, are commonly sold in standard sized containers. For example, paint is commonly sold in pint, quart and gallon-size metallic cans having an upper opening and base essentially the diameter of the can. In addition at the time of the sale, the paint is accompanied with a promotional giveaway such as a stir stick having a promotional advertisement printed on the stick.

In use, a paint brush is typically dipped into paint in the can and then removed, frequently resulting in dripping of paint onto the outside of the can and surrounding surfaces. As paint, or other liquid, drips, splatters and runs down the outside of the can, it can accumulate on the bottom of the can and create a ring of paint and spill or splatter marks on the surface area around the can. The same ring of paint may be unintentionally applied to other surfaces as the can is moved from place to place. Another common problem is that of tipping the paint can over. A painter also has the problem of finding a place to temporarily rest the paint-covered brush while attending other tasks associated with the overall painting job.

In use, the stir stick, which has a handle and an elongated end, is dipped in the paint can to mix the paint, as a result any advertisement printed on the elongated end is covered with paint and the printed advertisement is eliminated. In addition, while it is held and used any printed advertisement on the handle is not visible.

Many prior attempts have been made to mitigate the problems associated with liquid drips from liquid containers. For example:

U.S. Pat. No. 5,759,275 to Shostak discloses a portable paint shield comprised of a board, having a circular hole in the center, which is attachable to a can by the use of teeth like protrusions. The hole is the approximate diameter of the paint can. The can does not rest on the surface of the board and the hole is inefficient in preventing liquid, which drips down the side of the can, from seeping through the space between the edge of the hole and the side of the can. In addition, the method of attaching the shield to the paint can is cumbersome and ineffective. The can must be of the exact size of the diameter of the hole so as to be held in place and thus one paint shield is not suitable for various sized cans.

U.S. Pat. No. 3,606,074 to Hayes discloses a stepped pan as a securing cover for the paint can, and on reversing the pan, it makes a drip-pan into which the paint can may be set, but not attached.

U.S. Pat. No. 4,325,323 to Rioux, discloses a three panel rigid paint splatter board. Two boards extend from each side of the central frame. The unit is mounted on casters. A clamp and bolts secure a paint vessel to the central frame. This device requires more time and energy to place than tarps or newspaper and is clearly more expensive. The three boards are of a rigid material, therefore requiring a clear path for movement along a wall. Also, the clamps and bolts used to secure the paint vessel are time consuming. Furthermore, this device cannot be used on a ladder.

U.S. Pat. No. 2,936,926 to Miller discloses a drip pan for trash containers, in which the pan has a central, tight fitting collar to permit the trash container to be placed in the collar and be secured therein. The unit is made of resilient material so as to be retained on the container.

The present invention seeks to alleviate the problems associated with the prior art devices for catching drips from open liquid containers and to provide a device that is used as an in home advertisement.

SUMMARY OF THE INVENTION

It is an object of the present invention to provide a device to be connected to a liquid container to catch spills, drips and the like therefrom.

It is a further object to provide such a device that can be easily attached to and removed from a can of paint.

It is still a further object to provide a paint mat device that can continually remain attached to a can of paint while it is moved during the course of painting.

It is another object of the invention to provide a reusable paint mat which is nevertheless sufficiently inexpensive to be used as a throw-away unit.

It is still another object to provide a paint mat that acts as a stabilizing base that prevents the can of paint from being easily tipped over.

Another object of the invention is to provide a device for catching drips adapted to accommodate a plurality of standard size containers.

Still another object of the invention is to provide a paint mat device suitable to be sold at retail stores or used for promotional giveaways and that may serve as an advertisement billboard.

The above and other objects are accomplished in accordance with the present invention which comprises a device for collecting spills from a liquid container, comprising a board having a top side, a bottom side, and a peripheral edge defining a continuous surface; and including a means for attachment to a base of the liquid container whereby the peripheral edge of the board surrounds the base of the liquid container.

The device of the present invention and its use may be readily understood with reference to its use as a paint mat wherein the liquid container is a paint can and the attachment means is suited thereto. Paint cans are commonly made of a magnetic metal. In a preferred embodiment, for use with such containers, the means of attachment of the present device is a magnet. The magnet is preferably positioned near the center of the board and may be conveniently secured thereto by glue, cement or the like. The magnet is preferably flat and sufficiently small; so as to conveniently fit under the base of the paint can while allowing the can to remain level and stable. When attached to the paint can, the board should extend a suitable distance beyond the base to collect drips of paint and minor spills and prevent them from dropping onto the surface below.

The preferred means of attachment, for use with liquid containers having a base of a magnetic material, is a magnet. However, there is an increasing use of various non-magnetic materials such as aluminum, plastic, glass and the like, in the manufacture of paint cans and other containers for liquid materials. Various other means of attachment, suitable for attachment to either a magnetic or non-magnetic container base include for example, two-sided adhesive strips, hook and loop fasteners, and the like.

In a preferred embodiment, for convenience, the paint mat of the present invention may be configured with an extension, suitable for resting a paint brush on during a pause in the painting operation.

In an additional preferred embodiment, the paint mat may include a message, such as an advertisement for the manufacturer, customer or seller of the device. Furthermore, the paint mat may include a means for hanging on a display rack in a sales display, or a wall hook or pegboard in the user's home. Various means may be used for such purposes, the preferred being a simple hole in the mat that is suitable for hanging on a hook. Advantageously, such a hole is positioned in the central region of the mat in the area that will be covered by the base of the paint can during use and thus will avoid the possibility of dripping paint passing through to the surface being protected.

Although the anticipated primary purpose for the device of the present invention is to serve as a paint mat, that is, by attachment to the base of a paint can, it will be appreciated that other purposes and uses may be served as well. Thus, for example, the device may be attached to containers for oil, cleaning fluids, acids, various liquid chemicals, and the like to prevent accidental loss of the fluid through spills or drips and to protect the surface below.

BRIEF DESCRIPTION OF THE DRAWINGS

The nature and mode of operation of the present invention will now be more fully described in the following detailed description taken with the accompanying drawings wherein:

FIG. 1 is a top perspective view of the present invention;

FIG. 2 is bottom perspective view of the present invention;

FIG. 3 is side elevational view of the present invention;

FIG. 4A is top elevational view, taken generally along line 4A—4A in FIG. 3;

FIGS. 4B–4D are top elevational views of the present invention illustrating various forms of a means to attach the present invention to a container;

FIG. 5 is a semi-exploded view of a container and the present invention;

FIG. 6 is a perspective view of the present invention;

FIG. 7A is a cut away view of the present invention using a magnet connector, taken generally along line 7A—7A in FIG. 6;

FIG. 7B is a cut away view of the present invention using a hook and loop connecter, taken generally along line 7A—7A in FIG. 6;

FIG. 8 is a perspective view of the present invention being lifted free of the surface of a table or a floor;

FIG. 9 is an elevational side view being displayed on a vertical surface;

FIG. 10 is a perspective view showing the present invention having a brush rest;

FIG. 11 is a view of various preferred embodiments of the present invention; and FIG. 12 is a view of the present invention that includes a lip extending upwardly around the peripheral edge of the board.

DETAILED DESCRIPTION OF THE INVENTION

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112.

Adverting now to the drawings, FIG. 1 illustrates a preferred embodiment of the invention, a device for collecting drips from a liquid container. In the embodiment shown paint mat 10 includes board 15 with means for attachment 20, fixedly mounted in the central portion of the board. Means for attachment 20 in this preferred embodiment is a thin magnet fixedly attached to board 15 by an adhesive. A liquid container made of metal may be placed on the mat so that magnet 20 is attracted to the bottom of the container, and thereby detachably attaches the mat to the container. Board 15 is made of a rigid or semi-rigid material such as paperboard or wood. A typical metal paint can has no splatter guard or protective shield to catch drips of paint that reach the bottom of the can. As paint, or other liquid, runs down the outside of the can, it can collect on a supporting surface for the can causing clean-up problems or damage to the supporting surface. There are few devices available to deal with this problem. The paint mat of the present invention uniquely solves the problem in a way not contemplated by the prior art. The paint mat device of the present invention provides a quick attachable board that collects liquid that drips from a container and protects surrounding surfaces from spills from a liquid container.

The present invention solves another problem in the paint industry. Currently in the paint industry, as in all manufacturing and retail industries, companies are searching for ways to reach out and advance name recognition with consumers. The paint mat is a medium for advertising. As shown in FIG. 1, board 15 has top surface 16 that includes an area that is used as space for printed advertisement 11. Paint mat 10 includes aperture 12 as a means for hanging paint mat 10 on a vertical surface. Because this device is reusable a consumer needs a place to store it when it is not used in connection with a can. A preferred place to store it would be a wall in a garage or workroom, so that it may act as continuous advertisement billboard. The paint mat device of the present invention provides an economical way to solve a consumer's need to guard against spills and an advertiser's need to get their message to the consumer.

In another view of the present invention, FIG. 2 shows bottom side 17 of board 15 that includes aperture 12 and printed advertisement 11. This view shows that the device accommodates an advertisement on the entire bottom side of the board so that paint mat 10 can be used as a miniature billboard in the home of the consumer.

In a preferred embodiment of the present invention, as shown in FIG. 3, paint mat 10 includes means for attachment 20 in the form of a magnet arranged to be mounted to board 15 wherein the magnet protrudes out from the top side of the board.

FIG. 4A is a top elevational view, taken generally along line 4A—4A in FIG. 3. FIGS. 4A–4D illustrate top elevational views of the present invention showing various forms of means for attachment 20 that are used with the present invention. In addition it should be understood these views depict peripheral edge 18 as an amorphous uneven line to further illustrate that board 15 is comprised a of multiplicity of shapes and dimensions. In FIG. 4A means for attachment 20 generally comprises a thin lightweight magnet fixedly mounted to top side 16 at a central portion of board 15. FIG. 4B depicts circular magnet 21 fixedly mounted to top side 16 at a central portion of board 15. It should be understood that liquid containers are comprised of material other than metal and many combinations of various other means of attachment are also possible.

FIG. 4C depicts loop fastener, 22A fixedly mounted to top side 16 at a central portion of board 15. Thus, the invention makes use of, in one aspect, hook and loop fasteners for detachable attachment of a device for collecting drips, such as a paint mat, to a liquid container, such as a paint can, wherein the central portion of top side 16 includes loop fastener 22A. Loop fastener 22A can comprise a relatively thin flexible sheet, substantially covered with loops on its upper surface and adhesive on its lower surface (not shown in the figures).

FIG. 4D depicts two sided adhesive 23 with a peel off backing. Once the backing is peeled off exposing the adhesive, the device can be fixedly attached to a container. Certainly those embodiments shown in FIGS. 4A–4D are not exhaustive and it should be appreciated that other suitable materials than those illustrated are used as means for attachment 20 for the present invention.

FIG. 5 is a semi-exploded view of the invention which illustrates paint can 25 arranged proximate paint mat 10. Paint can 25 is attached to paint mat 10 by moving the paint can in the direction of arrow 24. Paint can 25 is comprised of a standard metal can and means for attachment 20 is a magnet that is attracted to the metal can and removably connects the invention to paint can 25 and the like. Although the preferred embodiment calls for the magnet to come into actual contact with the base of the can it should be noted that the magnet could be positioned on either side of the board depending on the thickness of the board and the strength of the magnet.

In FIG. 6 paint can 25 is shown attached to a preferred embodiment of the present invention. This view illustrates paint mat 10 resting on supporting surface 30 (a floor or table for example). Paint that spills from the can in the form of drip 31 is collected on board 15 before it reaches peripheral edge 18 and supporting surface 30. The board is of a sufficient size so as to provide protection to the surface about the can. In addition, top side 16 is circumferentially visible continuously along peripheral edge 18 to the base of the can. This visible area includes printed advertisement 11. Thus while attached to paint can 25 the paint mat is a constant visible advertisement at the base of the can making an impression in the consumers mind. In addition, the board is a stabilizing foundation that prevents the can from being tipped over.

FIG. 7A is a cut away view of the present invention connected to paint can 25, taken generally along line 7A—7A in FIG. 6. In the preferred embodiment the base of paint can 25 extends past and covers aperture 12. Aperture 12 is thus covered by base 26 so that liquid that reaches board 15 will not seep through aperture 12 to supporting surface 30. This view also shows a space between the base of the can and the top side of the paint mat device of the present invention after connection. Paint can 25 is attached to paint mat 10 by means for attachment 20 in the form of a magnet. The magnet is operatively arranged to protrude upward to bridge the space between the can and the board and make contact with the can. The magnet is preferably flat and sufficiently sized so as to fit under the base of the paint can while allowing the can to remain level and stable.

FIG. 7B illustrates the same view as shown in FIG. 7A with loop fastener 22A and hook fastener 22B used as a means for attachment instead of a magnet. In this embodiment of the present invention loop fastener 22A is fixedly attached to board 15 and hook fastener 22B is fixedly attached to the base of paint can 25. The hook and loop fasteners are operatively arranged to protrude out from the board and can so as to allow the board to be connected to the can. In this embodiment of the present invention paint mat 10 is detachably secured to paint can 25 by matching the hook fastener to engage the loop fastener. The hook and loop fasteners are preferably flat and sufficiently sized so as to fit under the base of the paint can while allowing the can to remain level and stable. Although it is a preferred embodiment to have the loop fastener attached to the paint mat it should be obvious that either fastener can be fixedly attached to either the can or the paint mat. In a preferred embodiment hook fastener 22B includes an adhesive backing with a peel away paper covering, as does the loop fastener (not shown in the figures).

FIG. 8 is a perspective view of the present invention moved from supporting surface 30. Paint can 25 is moved or lifted in the direction of arrows 32 and paint mat 10 continually remains attached to paint can 25. Paint mat 10 and paint can 25 are carried simultaneously while moved during the course of painting.

FIG. 9 is an elevational side view of the present invention. Paint mat 10 is hung against vertical surface 13 by inserting peg 14 through aperture 12. A likely vertical surface would be a pegboard located in a consumer's garage or work area. Aperture 12 allows the device to be hung on peg 14 (a nail, a peg, a hook, a thumb tack and the like) and bottom side 17 provides a continuous area to place advertisement 11 (printed lettering or design). In this hanging state paint mat 10 serves as an in home billboard that displays printed advertisement 11.

Another preferred embodiment of the present invention includes brush rest 28 as an extension of paint mat 10 as shown in FIG. 10. Brush rest 28 is a rectangular extension from peripheral edge 18 of board 15. Brush rest 28 is the approximate size of a standard paintbrush. Brush 29 is shown on FIG. 10 positioned on brush rest 28. It should be appreciated that brush rest 28 can comprise any shaped structure suitably configured and constructed to thus engage the brush (such as a square or circular shape as an extension for brush rest 28 for example).

FIG. 11 is a view of various preferred embodiments of the present invention. As can be appreciated the current invention is made to accommodate various sized and shaped containers. The circular, rectangular and square shapes displayed are for illustrative purposes only and are not meant to be limiting. In addition, the board of this invention is made from various rigid or semi-rigid materials such as flat or molded plastic, corrugated plastic, paper and pulp board, corrugated or solid cardboard, wood and felt or different combinations of the same, for example. The type of material used to construct the board is dependant on the type of liquid in the container and the preference of the user. Various materials comprising a variety of qualities (such as absorption, sturdiness, thickness, rigidity and flexibility to name a few) can be used in the manufacture of the board.

FIG. 12 is a view of another preferred embodiment of the present invention that includes lip 33 extending upwardly around the peripheral edge of the board. Peripheral edge 18 of paint mat 10 is molded upward or turned-up (furled) along the entire circumference of the board. The furled edge reduces flow resistance of any fluid that travels down the side of the can and collects on the board of the present invention. Also illustrated in FIG. 12, is means for attachment 20 fixedly attached to a central portion of the board of the present invention.

As will be appreciated, the present invention provides a sound and effective paint mat that is also used as a forum for residential advertisement. The invention overcomes some of the deficiencies in the prior art by allowing the efficient connectivity of the paint mat to a paint can. It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings, shall be interpreted as illustrative and not in a limiting sense. While the invention has been described with reference to certain preferred embodiments, it will be appreciated by those skilled in the art that modifications and variations may be made without departing from the spirit and scope of the invention as defined in the appended claims.

It is also to be understood that the following claims are intended to cover all the generic and specific features of the invention herein described, and all statements of the scope of the invention that, as a matter of language, might be said to fall therebetween.

What is claimed is:

1. A device for collecting and absorbing spills from a paint container, comprising a flat board comprised of an absorbent paper material having a top side, a bottom side, and a peripheral edge and including a means for attachment to the center of a base of said paint container whereby, when attached, the peripheral edge of said board surrounds said base of said paint container and said base rests on said top side, said board having an advertisement on at least one side thereof and a means for detachably hanging said device on a vertical surface, wherein said board includes an extension therefrom so as to allow a brush to rest.

2. A device for collecting and absorbing drips from a paint-container according to claim 1 wherein said means for attachment to said base of said liquid container is a magnet.

3. A device for collecting and absorbing drips from a paint container according to claim 1 wherein said means for attachment to said base of said liquid container is a hook and loop connector.

4. A device for collecting and absorbing drips from paint container according to claim 1 wherein said board is a comprised of pulp board.

5. A device for collecting and absorbing drips from a paint container according to claim 1 wherein said board includes an aperture as a means for detachably hanging said device on said vertical surface.

6. A device for collecting and absorbing drips from a paint container according to claim 1 wherein said board is of a circular shape.

7. A device for collecting and absorbing drips from a paint container according to claim 1 wherein said board is of a square shape.

8. A device for collecting and absorbing drips from a paint container, comprising: a flat board comprised of an absorbent pulp board having a top side, a bottom side and a peripheral edge; said board having a magnet in a central portion thereof as a means for attachment to the center of a base of said liquid container, said board having an advertisement on at least one side thereof and a means for detachably hanging said device on a vertical surface; said base having a perimeter and said board having a perimeter greater than that of said base so as to allow said peripheral edge to extend beyond said base, wherein said board includes an extension therefrom so as to allow a brush to rest.

9. A device for collecting and absorbing drips from a paint container according to claim 8 wherein said board includes an aperture distal to said central portion but not extending past said perimeter of said base.

10. A device for collecting and absorbing drips from a paint container according to claim 8 wherein said board includes a lip extending upwardly around said peripheral edge thereof.

* * * * *

UNITED STATES PATENT AND TRADEMARK OFFICE

CERTIFICATE OF CORRECTION

PATENT NO. : 6,971,420 B2
DATED : December 6, 2005
INVENTOR(S) : Thomas Christopher Demitry It is certified that error appears in the above-identified patent and that said Letters Patent is hereby corrected as shown below:

Title page,
Item [76], Inventor, correct address is:
-- 42 Silent Meadow Lane
Orchard Park, NY 14127 --.

Signed and Sealed this

Thirty-first Day of January, 2006

JON W. DUDAS
*Director of the United States Patent and Trademark Office*